US011186885B2

(12) United States Patent
Yuga et al.

(10) Patent No.: US 11,186,885 B2
(45) Date of Patent: Nov. 30, 2021

(54) HIGH-STRENGTH SEAMLESS STEEL PIPE FOR OIL COUNTRY TUBULAR GOODS, AND PRODUCTION METHOD FOR HIGH-STRENGTH SEAMLESS STEEL PIPE FOR OIL COUNTRY TUBULAR GOODS

(71) Applicant: JFE Steel Corporation, Tokyo (JP)

(72) Inventors: Masao Yuga, Tokyo (JP); Mitsuhiro Okatsu, Tokyo (JP); Hiroki Ota, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 304 days.

(21) Appl. No.: 16/064,086

(22) PCT Filed: Oct. 18, 2016

(86) PCT No.: PCT/JP2016/004609
§ 371 (c)(1),
(2) Date: Jun. 20, 2018

(87) PCT Pub. No.: WO2017/110027
PCT Pub. Date: Jun. 29, 2017

(65) Prior Publication Data

US 2019/0024201 A1 Jan. 24, 2019

(30) Foreign Application Priority Data

Dec. 22, 2015 (JP) ..... JP2015-249956
Jun. 30, 2016 (JP) ..... JP2016-129714

(51) Int. Cl.

| | |
|---|---|
| ***C21D 8/10*** | (2006.01) |
| ***C22C 38/32*** | (2006.01) |
| ***C22C 38/54*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C21D 1/18*** | (2006.01) |

(52) U.S. Cl.

CPC ..... *C21D 8/105* (2013.01); *C21D 1/18* (2013.01); *C21D 9/085* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/004* (2013.01); *C21D 2211/008* (2013.01)

(58) Field of Classification Search

CPC ..... C21D 8/105; C21D 1/18; C21D 9/085; C21D 2211/004; C21D 2211/008; C22C 38/001; C22C 38/002; C22C 38/02; C22C 38/04; C22C 38/06; C22C 38/20; C22C 38/22; C22C 38/24; C22C 38/26; C22C 38/28; C22C 38/32; C22C 38/42; C22C 38/44; C22C 38/46; C22C 38/48; C22C 38/50; C22C 38/54

See application file for complete search history.

(56) References Cited

U.S. PATENT DOCUMENTS 4,075,041 A 2/1978 Ueno et al.
4,178,979 A * 12/1979 Birat ..... B22D 11/122 164/468

(Continued)

FOREIGN PATENT DOCUMENTS

CN 102409240 6/2013
EP 2447386 5/2012

(Continued)

OTHER PUBLICATIONS

Holappa ("Secondary steelmaking." Treatise on Process Metallurgy. Elsevier, 2014. 301-345. Chapter 1.6.) (Year: 2014).*
JP-2001131698-A English translation (Year: 2001).*

(Continued)

*Primary Examiner* — Steven J Bos
*Assistant Examiner* — Ricardo D Morales
(74) *Attorney, Agent, or Firm* — DLA Piper LLP (US)

(57) ABSTRACT

The high-strength seamless steel pipe has a volume fraction of tempered martensite of 95% or more, and a prior austenite size number of 8.5 or more, and contains nitride inclusions having a size of 4 μm or more and whose number is 100 or less per 100 $mm^2$, nitride inclusions having a size of less than 4 μm and whose number is 700 or less per 100 $mm^2$, oxide inclusions having a size of 4 μm or more and whose number is 60 or less per 100 $mm^2$, and oxide inclusions having a size of less than 4 μm and whose number is 500 or less per 100 $mm^2$, in a cross section perpendicular to a rolling direction.

4 Claims, No Drawings

(56) References Cited

U.S. PATENT DOCUMENTS

| | | | | |
|---|---|---|---|---|
| 9,708,681 | B2 | 7/2017 | Eguchi et al. | |
| 2004/0238075 | A1 | 12/2004 | Kondo | |
| 2006/0016520 | A1* | 1/2006 | Numata | C22C 38/22 148/335 |
| 2008/0219878 | A1 | 9/2008 | Kondo et al. | |
| 2012/0186704 | A1* | 7/2012 | Eguchi | C22C 38/06 148/500 |
| 2013/0084205 | A1 | 4/2013 | Numata et al. | |
| 2014/0352836 | A1 | 12/2014 | Eguchi et al. | |
| 2015/0041030 | A1 | 2/2015 | Kondo et al. | |
| 2017/0275715 | A1 | 9/2017 | Yuga et al. | |
| 2017/0349963 | A1 | 12/2017 | Yuga et al. | |
| 2017/0349964 | A1 | 12/2017 | Yuga et al. | |
| 2018/0327881 | A1 | 11/2018 | Yuga et al. | |
| 2019/0024201 | A1 | 1/2019 | Yuga et al. | |

FOREIGN PATENT DOCUMENTS

| | | | | |
|---|---|---|---|---|
| EP | 2796587 | A1 | | 10/2014 |
| JP | 2000-178682 | A | | 6/2000 |
| JP | 2000-297344 | A | | 10/2000 |
| JP | 2001131698 | A | * | 5/2001 |
| JP | 2001-172739 | A | | 6/2001 |
| JP | 2007-016291 | A | | 1/2007 |
| JP | 2012-026030 | A | | 2/2012 |
| JP | 2012-519238 | A | | 8/2012 |
| JP | 2013-227611 | A | | 11/2013 |
| JP | 2014-012890 | | | 1/2014 |
| WO | 2010/150915 | A1 | | 12/2010 |
| WO | 2013/094179 | A1 | | 6/2013 |
| WO | 2016-103537 | A1 | | 6/2016 |

OTHER PUBLICATIONS

Official Action dated Sep. 5, 2019, of related U.S. Appl. No. 15/509,350.

Official Action dated Apr. 16, 2019, of related U.S. Appl. No. 15/509,350.

Official Action dated Jun. 24, 2019, of related U.S. Appl. No. 15/527,893.

Supplementary European Search Report dated Aug. 28, 2018, of counterpart European Application No. 16877932.

Official Action dated Jan. 6, 2020, of related U.S. Appl. No. 15/527,893.

Official Action dated Oct. 30, 2019, of related U.S. Appl. No. 15/537,669.

Official Action dated Oct. 30, 2019, of related U.S. Appl. No. 15/537,703.

Official Action dated Feb. 25, 2019, of related U.S. Appl. No. 15/509,361.

Official Action dated Apr. 30, 2020, of related U.S. Appl. No. 15/537,669.

Official Action dated Aug. 19, 2020, of related U.S. Appl. No. 15/527,893.

Official Action dated May 12, 2020, of related U.S. Appl. No. 15/527,893.

Official Action dated Oct. 1, 2021, of related U.S. Appl. No. 16/956,800.

* cited by examiner

HIGH-STRENGTH SEAMLESS STEEL PIPE FOR OIL COUNTRY TUBULAR GOODS, AND PRODUCTION METHOD FOR HIGH-STRENGTH SEAMLESS STEEL PIPE FOR OIL COUNTRY TUBULAR GOODS

TECHNICAL FIELD

This disclosure relates to a high-strength seamless steel pipe preferred for use as oil country tubular goods (or called "OCTG") or line pipes, and particularly to improvement of sulfide stress corrosion cracking resistance (or called "SSC resistance") in a moist hydrogensulfide environment (sour environment).

BACKGROUND

For stable supply of energy resources, there has been development of oil fields and natural gas fields deep under the ground of a severe corrosion environment. This has created a strong demand for drilling oil country tubular goods (hereinafter called "OCTG") and transporting line pipes that have excellent SSC resistance in a hydrogen sulfide ($H_2S$) sour environment while maintaining high strength with a yield strength YS of 125 ksi (862 MPa) or more.

To meet such demands, for example, Japanese Unexamined Patent Application Publication No. 2000-178682 proposes a method of producing a steel for OCTG whereby a low alloy steel containing C: 0.2 to 0.35%, Cr: 0.2 to 0.7%, Mo: 0.1 to 0.5%, and V: 0.1 to 0.3% by weight is tempered between 650° C. and a temperature at or below the $Ac_1$ transformation point after being quenched at $A_3$ transformation or more. The technique of JP '682 is described as being capable of achieving 8 to 40 weight % of an MC-type carbide with respect to the total amount, 2 to 5 weight %, of the precipitated carbide, and producing a steel for OCTG having excellent sulfide stress corrosion cracking resistance.

Japanese Unexamined Patent Application Publication No. 2000-297344 proposes a method of producing a steel for OCTG having excellent toughness and excellent sulfide stress corrosion cracking resistance. That method heats a low alloy steel containing C: 0.15 to 0.3%, Cr: 0.2 to 1.5%, Mo: 0.1 to 1%, V: 0.05 to 0.3%, and Nb: 0.003 to 0.1% by mass to at least 1,150° C. After hot working performed at 1,000° C. or higher temperature, the steel is subjected to one or more round of quenching and tempering that includes quenching at a temperature of 900° C. or higher, tempering between 550° C. and a temperature at or below the $Ac_1$ transformation point, reheating and quenching at 850 to 1,000° C., and tempering between 650° C. and a temperature at or below the $Ac_1$ transformation point. The technique of JP '344 is described as being capable of achieving 5 to 45 mass % of an MC-type carbide, and 200/t (t: wall thickness (mm)) mass % or less of an $M_{23}C_6$-type carbide with respect to the total amount, 1.5 to 4 mass %, of the precipitated carbide, and producing a steel for OCTG having excellent toughness and excellent sulfide stress corrosion cracking resistance.

Japanese Unexamined Patent Application Publication No. 2001-172739 proposes a steel material for OCTG that contains C: 0.15 to 0.30 mass %, Si: 0.05 to 1.0 mass %, Mn: 0.10 to 1.0 mass %, P: 0.025 mass % or less, S: 0.005 mass % or less, Cr: 0.1 to 1.5 mass %, Mo: 0.1 to 1.0 mass %, Al: 0.003 to 0.08 mass %, N: 0.008 mass % or less, B: 0.0005 to 0.010 mass %, Ca+O (oxygen): 0.008 mass % or less, and one or more of Ti: 0.005 to 0.05 mass %, Nb: 0.05 mass % or less, Zr: 0.05 mass % or less, and V: 0.30 mass % or less, and in which continuous non-metallic inclusions have a maximum length of 80 μm or less, and the number of non-metallic inclusions with a particle size of 20 μm or more is 10 or less per 100 $mm^2$ as observed in a cross section. The low alloy steel material for OCTG obtained in that publication is described as having the high strength required for OCTG, and a excellent level of SSC resistance that can be expected from such high strength.

Japanese Unexamined Patent Application Publication No. 2007-16291 proposes a low alloy steel for oil country tubular goods (OCTG) having excellent sulfide stress corrosion cracking resistance. The steel contains C: 0.20 to 0.35 mass %, Si: 0.05 to 0.5 mass %, Mn: 0.05 to 0.6 mass %, P: 0.025 mass % or less, S: 0.01 mass % or less, Al: 0.005 to 0.100 mass %, Mo: 0.8 to 3.0 mass %, V: 0.05 to 0.25 mass %, B: 0.0001 to 0.005 mass %, N: 0.01 mass % or less, and O: 0.01 mass % or less, and satisfies $12V+1-Mo \geq 0$. The composition according to the technique of JP '291 is described as containing optional components: 0.6 mass % or less of Cr satisfying $Mo-(Cr+Mn) \geq O$; at least one of Nb: 0.1 mass % or less, Ti: 0.1 mass % or less, and Zr: 0.1 mass % or less; or Ca: 0.01 mass % or less.

However, because the sulfide stress corrosion cracking resistance (SSC resistance) are multiple factors, the techniques described in JP '682, JP '344, JP '739 and JP '291 are not sufficient if the characteristics of a high-strength seamless steel pipe of a grade equivalent to or higher than a YS of 125 ksi (862 MPa) were to be improved to make the SSC resistance sufficient for use in the severe corrosion environment of oil wells. There is also great difficulty in stably adjusting the type and the amount of carbide within desired ranges as taught in JP '682 and JP '344, or stably adjusting the shape and the number of non-metallic inclusions within desired ranges as taught in JP '739.

It could therefore be helpful to provide a high-strength seamless steel pipe for OCTG having excellent sulfide stress corrosion cracking resistance, and a method of producing such a high-strength seamless steel pipe.

As used herein, "high-strength" means strength with a yield strength YS of 125 ksi (862 MPa) or more. The yield strength YS is preferably 140 ksi (965 MPa) or less. As used herein, "excellent sulfide stress corrosion cracking resistance" means that a subject material does not crack even after 720 hours of applied stress equating to 90% of its yield strength in a constant load test conducted according to the test method specified in NACE TM0177 Method A using an acetic acid-sodium acetate aqueous solution (liquid temperature: 24° C.) containing a 5.0 mass % saltwater solution of pH 3.5 with saturated 10 kPa hydrogen sulfide.

SUMMARY

We found that nitride inclusions and oxide inclusions have large impact on SSC resistance in high-strength steel pipes of a grade equivalent to or higher than a yield strength YS of 125 ksi, though the extent of the impact varies with the size of the inclusions. We also found that nitride inclusions with a size of 4 μm or more, and oxide inclusions with a size of 4 μm or more become an initiation of sulfide stress corrosion cracking (SSC), and SSC becomes more likely to occur as the size of the nitride and oxide inclusions increases. We further found that nitride inclusions with a size of less than 4 μm do not become an initiation of SSC by themselves, but adversely affect the SSC resistance when present in large numbers. We still further found that oxide inclusions of less than 4 μm have an adverse effect on SSC resistance when present in large numbers.

To further improve SSC resistance we control the number of nitride and oxide inclusions by size to fall below appropriate numbers. For the number of nitride and oxide inclusions to fall below appropriate numbers, it is important to control the N and O amounts within the required ranges during the production of a steel pipe material, particularly during the production and casting of molten steel. It is also important to manage manufacturing conditions in a steel refining step and in a continuous casting step.

We thus provide:

(1) A high-strength seamless steel pipe for oil country tubular goods of a composition comprising C: 0.20 to 0.50 mass %, Si: 0.05 to 0.40 mass %, Mn: 0.1 to 1.5 mass %, P: 0.015 mass % or less, S: 0.005 mass % or less, Al: 0.005 to 0.1 mass %, N: 0.006 mass % or less, Cr: 0.1 to 2.5 mass %, Mo: 0.1 to 1.0 mass %, V: 0.03 to 0.3 mass %, Nb: 0.001 to 0.030 mass %, B: 0.0003 to 0.0030 mass %, O (oxygen): 0.0030 mass % or less, Ti: 0.003 to 0.025 mass %, and the balance Fe and unavoidable impurities, and satisfying Ti/N=2.0 to 5.5, wherein the high-strength seamless steel pipe has a structure in which a volume fraction of tempered martensite is 95% or more, and a prior austenite grain size number is 8.5 or more, and that contains nitride inclusions which have a size of 4 μm or more and whose number is 100 or less per 100 $mm^2$, nitride inclusions which have a size of less than 4 μm and whose number is 700 or less per 100 $mm^2$, oxide inclusions which have a size of 4 μm or more and whose number is 60 or less per 100 $mm^2$, and oxide inclusions which have a size of less than 4 μm and whose number is 500 or less per 100 $mm^2$, in a cross section perpendicular to a rolling direction, and wherein the high-strength seamless steel pipe has a yield strength YS of 862 MPa or more.

(2) The high-strength seamless steel pipe for oil country tubular goods according to item (1), wherein the composition further contains at least one selected from Cu: 1.0 mass % or less, Ni: 1.0 mass % or less, and W: 3.0 mass % or less.

(3) The high-strength seamless steel pipe for oil country tubular goods according to item (1) or (2), wherein the composition further contains Ca: 0.0005 to 0.0050 mass %.

(4) A method of producing the high-strength seamless steel pipe for oil country tubular goods of any one of items (1) to (3), the method comprising:

heating a steel pipe material at a heating temperature of 1,050 to 1,350° C., and subjecting the steel pipe material to hot working to obtain a seamless steel pipe of a predetermined shape; and cooling the seamless steel pipe after the hot working at a cooling rate equal to or faster than air cooling until a surface temperature becomes 200° C. or less, and tempering the seamless steel pipe by heating the pipe to 600 to 740° C.

(5) The method according to item (4), wherein the seamless steel pipe is subjected to quenching at least once after the cooling and before the tempering, the quenching involving reheating in a temperature range between an $Ac_3$ transformation point and 1,000° C., and quenching to a surface temperature of 200° C. or less.

A high-strength seamless steel pipe for OCTG can be provided that has high strength with a yield strength YS of 125 ksi (862 MPa) or more, and excellent sulfide stress corrosion cracking resistance, both easily and inexpensively. This is highly advantageous in industry. With the appropriate alloy elements contained in appropriate amounts, and with reduced generation of nitride inclusions and oxide inclusions, we stably produce a high-strength seamless steel pipe having excellent SSC resistance while maintaining the desired high strength for OCTG.

DETAILED DESCRIPTION

A high-strength seamless steel pipe for OCTG (hereinafter, also referred to simply as "high-strength seamless steel pipe") is of a composition containing C: 0.20 to 0.50 mass %, Si: 0.05 to 0.40 mass %, Mn: 0.1 to 1.5 mass %, P: 0.015 mass % or less, S: 0.005 mass % or less, Al: 0.005 to 0.1 mass %, N: 0.006 mass % or less, Cr: 0.1 to 2.5 mass %, Mo: 0.1 to 1.0 mass %, V: 0.03 to 0.3 mass %, Nb: 0.001 to 0.030 mass %, B: 0.0003 to 0.0030 mass %, O (oxygen): 0.0030 mass % or less, Ti: 0.003 to 0.025 mass %, and the balance Fe and unavoidable impurities, and satisfying Ti/N=2.0 to 5.5, wherein the high-strength seamless steel pipe has a structure in which a volume fraction of tempered martensite is 95% or more, and a prior austenite grain size number is 8.5 or more, and that contains nitride inclusions having a size of 4 μm or more and whose number is 100 or less per 100 $mm^2$, nitride inclusions having a size of less than 4 μm and whose number is 700 or less per 100 $mm^2$, oxide inclusions having a size of 4 μm or more and whose number is 60 or less per 100 $mm^2$, and oxide inclusions having a size of less than 4 μm and whose number is 500 or less per 100 $mm^2$, in a cross section perpendicular to a rolling direction. The high-strength seamless steel pipe has a yield strength YS of 862 MPa or more.

The reasons for specifying the composition in the high-strength seamless steel pipe is as follows. In the following, "%" solely used in conjunction with the composition means percent by mass.

C: 0.20 to 0.50%

C (Carbon) contributes to increasing steel strength by forming a solid solution. This element also contributes to improving hardenability of the steel and forming a structure of primarily a martensite phase during quenching. C needs to be contained in an amount of 0.20% or more to obtain such effects. The C content in excess of 0.50% causes cracking during quenching and deteriorates productivity. The C content is therefore 0.20 to 0.50%, preferably 0.20% or more, more preferably 0.24% or more. The C content is preferably 0.35% or less, more preferably 0.32% or less.

Si: 0.05 to 0.40%

Si (Silicon) is an element that acts as a deoxidizing agent, increases steel strength by dissolving into the steel as a solid solution, and prevents softening during tempering. Si needs to be contained in an amount of 0.05% or more to obtain such effects. The Si content in excess of 0.40% promotes generation of a softening ferrite phase and inhibits excellent strength improvement, or promotes formation of coarse oxide inclusions that deteriorates SSC resistance, or poor toughness. Si is also an element that segregates to bring about local hardening of the steel. The Si content in excess of 0.40% causes adverse effects by forming a locally hardened region and deteriorating the SSC resistance. For these reasons, Si is contained in an amount of 0.05 to 0.40%. The Si content is preferably 0.05 to 0.33%. More preferably, the Si content is 0.24% or more, and is 0.30% or less.

Mn: 0.1 to 1.5%

Mn (Manganese) is an element that improves hardenability of steel and contributes to increasing steel strength, as is C. Mn needs to be contained in an amount of 0.1% or more to obtain such effects. Mn is also an element that segregates to bring about local hardening of steel. An excess Mn content causes adverse effects by forming a locally hardened region and deteriorating SSC resistance. For these reasons, Mn is contained in an amount of 0.1 to 1.5%. The Mn content is preferably more than 0.3%, more preferably 0.5% or more. Preferably, the Mn content is 1.2% or less, more preferably 0.8% or less.

P: 0.015% or Less

P (Phosphorus) is an element that segregates at grain boundaries and causes embrittlement at grain boundaries. This element also segregates to bring about local hardening of steel. It is preferable to contain P as unavoidable impurities in as small an amount as possible. However, the P content of at most 0.015% is acceptable. For this reason, the P content is 0.015% or less, preferably 0.012% or less.

S: 0.005% or Less

S (Sulfur) represents unavoidable impurities existing mostly as sulfide inclusions in steel. Desirably, the S content should be reduced as much as possible because S deteriorate ductility, toughness, and SSC resistance. However, the S content of at most 0.005% is acceptable. For this reason, the S content is 0.005% or less, preferably 0.003% or less.

Al: 0.005 to 0.1%

Al (Aluminum) acts as a deoxidizing agent and contributes to reducing size of austenite grains during heating by forming AlN with N. Al fixes N and prevents binding of solid solution B to N to inhibit reduction of hardenability improving effect by B. Al needs to be contained in an amount of 0.005% or more to obtain such effects. The Al content in excess of 0.1% increases oxide inclusions, and lowers purity of steel. This deteriorates ductility, toughness, and SSC resistance. For this reason, Al is contained in an amount of 0.005 to 0.1%. The Al content is preferably 0.01% or more, more preferably 0.02% or more. Preferably, the Al content is 0.08% or less, more preferably 0.05% or less.

N: 0.006% or Less

N (Nitrogen) exists as unavoidable impurities in steel. This element refines grain size of microstructure by forming AlN with Al, and TiN with Ti, and improves toughness. However, the N content in excess of 0.006% produces coarse nitrides (the nitrides are precipitates that generate in a heat treatment, and inclusions that crystallize during solidification), which deteriorate SSC resistance, and toughness. For this reason, the N content is 0.006% or less.

Cr: 0.1 to 2.5%

Cr (Chromium) is an element that increases steel strength by improving hardenability, and that improves corrosion resistance. This element also enables producing a quenched structure by improving hardenability, even in thick materials. Cr is also an element that improves resistance to temper softening by forming carbide such as $M_3C$, $M_7C_3$ and $M_{23}C_6$ (where M is a metallic element) with C during tempering. Cr needs to be contained in an amount of 0.1% or more to obtain such effects. The Cr content is preferably more than 0.6%, more preferably more than 0.7%. The Cr content in excess of 2.5% results in excess formation of $M_7C_3$ and $M_{23}C_6$. These act as hydrogen trapping sites, and deteriorate SSC resistance. The excess Cr content may also decrease strength because of a solid solution softening phenomenon. For these reasons, the Cr content is 2.5% or less.

Mo: 0.1 to 1.0%

Mo (Molybdenum) is an element that forms carbide and contributes to strengthening steel through precipitation strengthening. This element effectively contributes to providing required high strength after tempering has reduced dislocation density. Reducing the dislocation density improves SSC resistance. Mo segregates at the prior austenite grain boundaries by dissolving into steel as a solid solution, and also contributes to improving SSC resistance. Mo also acts to make the corrosion product denser, and inhibit generation and growth of pits, which become an initiation of cracking. Mo needs to be contained in an amount of 0.1% or more to obtain such effects. The Mo content in excess of 1.0% is economically disadvantageous because it cannot produce corresponding effects as the effects become saturated against the increased strength. Such an excess content also promotes formation of acicular $M_2C$ precipitates or, in some cases, a Laves phase ($Fe_2Mo$), to deteriorate SSC resistance. For these reasons, Mo is contained in an amount of 0.1 to 1.0%. The Mo content is preferably 0.3% or more, preferably 0.9% or less, more preferably 0.7% or less.

V: 0.03 to 0.3%

V (Vanadium) is an element that forms carbide or carbon-nitride and contributes to strengthening steel. V needs to be contained in an amount of 0.03% or more to obtain such effects. The V content in excess of 0.3% is economically disadvantageous because it cannot produce corresponding effects as the effects become saturated. For this reason, the V is contained in a 0.03 to 0.3%. The V content is preferably 0.05% or more, and is preferably 0.25% or less.

Nb: 0.001 to 0.030%

Nb (Niobium) forms carbide or carbon-nitride, contributes to increasing steel strength through precipitation strengthening, and reduces size of prior austenite grains. Nb needs to be contained in an amount of 0.001% or more to obtain such effects. Nb precipitates tend to become a propagation pathway to SSC (sulfide stress corrosion cracking). Particularly, a presence of large amounts of Nb precipitates from an excess Nb content above 0.030% leads to a serious deterioration in SSC resistance, particularly in high-strength steel materials with a yield strength of 125 ksi or more. For these reasons, the Nb content is 0.001 to 0.030% from the standpoint of satisfying both excellent high strength and excellent SSC resistance. The Nb content is preferably 0.001% to 0.02%, more preferably less than 0.01%.

B: 0.0003 to 0.0030%

B (Boron) segregates at austenite grain boundaries and acts to increase steel hardenability by inhibiting ferrite transformation from grain boundaries, even when contained in trace amounts. B needs to be contained in an amount of 0.0003% or more to obtain such effects. When contained in excess of 0.0030%, B precipitates as, for example, carbon-nitride. This deteriorates hardenability and, in turn, toughness. For this reason, B is contained in an amount of 0.0003 to 0.0030%. The B content is preferably 0.0007% or more, preferably 0.0025% or less.

O (Oxygen): 0.0030% or Less

O (oxygen) represents unavoidable impurities, existing as oxide inclusions in steel. Oxide inclusions become an initiation of SSC generation and deteriorate SSC resistance. It is therefore preferable that O (oxygen) be contained in as small an amount as possible. However, the O (oxygen) content of at most 0.0030% is acceptable because the excessively small O (oxygen) content leads to increased refining cost. For these reasons, the O (oxygen) content is 0.0030% or less, preferably 0.0020% or less.

Ti: 0.003 to 0.025%

Ti (Titanium) precipitates as fine TiN by binding to N during solidification of molten steel, and its pinning effect contributes to reducing size of prior austenite grains. Ti needs to be contained in an amount of 0.003% or more to obtain such effects. A Ti content of less than 0.003% produces only small effects. A Ti content in excess of 0.025% produces coarse TiN and the toughness deteriorate as it fails to exhibit the pinning effect. Such coarse TiN also deteriorate SSC resistance. For these reasons, Ti is contained in a 0.003 to 0.025% range of: Ti/N: 2.0 to 5.5.

When Ti/N ratio is less than 2.0, N becomes insufficiently fixed and forms BN. Hardenability improving effect by B is deteriorated as a result. When the Ti/N ratio is larger than 5.5, tendency to form coarse TiN becomes more prominent, and toughness, and SSC resistance are deteriorated. For these reasons, Ti/N is 2.0 to 5.5. Ti/N is preferably 2.5 or more, and is preferably 4.5 or less.

Aside from the foregoing components, the composition contains the balance Fe and unavoidable impurities. The acceptable content of unavoidable impurities is 0.0008% or less for Mg, and 0.05% or less for Co.

In addition to the foregoing basic components, the composition may contain one or more optional elements selected from Cu: 1.0% or less, Ni: 1.0% or less, and W: 3.0% or less, and/or Ca: 0.0005 to 0.0050%.

One or More Elements Selected from Cu: 1.0% or Less, Ni: 1.0% or Less, and W: 3.0% or Less Elements Cu, Ni, and W all contribute to increasing steel strength, and one or more of these elements may be contained, as needed.

Cu (Copper) is an element that contributes to increasing steel strength, and acts to improve toughness, and corrosion resistance. This element is particularly effective to improve SSC resistance in a severe corrosion environment. When Cu is contained, a dense corrosion product is formed, and corrosion resistance improves. Cu also reduces generation and growth of pits, which become an initiation of cracking. Cu is contained in an amount of desirably 0.03% or more to obtain such effects. Containing Cu in excess of 1.0% is economically disadvantageous because it cannot produce corresponding effects as the effects become saturated. It is therefore preferable that Cu, when contained, is limited to a content of 1.0% or less.

Ni (Nickel) is an element that contributes to increasing steel strength, and acts to improve toughness, and corrosion resistance. Ni is contained in an amount of desirably 0.03% or more to obtain such effects. Containing Ni in excess of 1.0% is economically disadvantageous because it cannot produce corresponding effects as the effects become saturated. It is therefore preferable that Ni, when contained, is limited to a content of 1.0% or less.

W (Tungsten) is an element that forms carbide and contributes to increasing steel strength through precipitation strengthening. This element also segregates as a solid solution at the prior austenite grain boundaries, and contributes to improving SSC resistance. W is contained in an amount of desirably 0.03% or more to obtain such effects. Containing W in excess of 3.0% is economically disadvantageous because it cannot produce corresponding effects as the effects become saturated. It is therefore preferable that W, when contained, is limited to a content of 3.0% or less.

Ca: 0.0005 to 0.0050%

Ca (Calcium) is an element that forms CaS with S, and that acts to effectively control the form of sulfide inclusions. By controlling the form of sulfide inclusions, Ca contributes to improving toughness, and SSC resistance. Ca needs to be contained in an amount of 0.0005% or more to obtain such effects. Containing Ca in excess of 0.0050% is economically disadvantageous because it cannot produce corresponding effects as the effects become saturated. It is therefore preferable that Ca, when contained, is limited to a content of 0.0005 to 0.0050%.

Our high-strength seamless steel pipe has the foregoing composition, and has a structure in which a volume fraction of main phase tempered martensite is 95% or more, and a prior austenite grain size number is 8.5 or more, and contains nitride inclusions having a size of 4 or more and whose number is 100 or less per 100 $mm^2$, nitride inclusions having a size of less than 4 μm and whose number is 700 or less per 100 $mm^2$, oxide inclusions having a size of 4 μm or more and whose number is 60 or less per 100 $mm^2$, and oxide inclusions having a size of less than 4 μm and whose number is 500 or less per 100 $mm^2$, in a cross section perpendicular to a rolling direction.

Tempered Martensite Phase: 95% or More

In the high-strength seamless steel pipe, a tempered marten-site phase after tempering of a martensite phase represents a main phase so that a high strength equivalent to or higher than a YS of 125 ksi can be provided while maintaining the required ductility and toughness for the product structure. As used herein "main phase" refers to when the phase is a single phase with a volume fraction of 100%, or when the phase has a volume fraction of 95% or more with a second phase contained in a volume fraction, 5% or less, that does not affect the characteristics. Examples of such a second phase include a bainite phase, a residual austenite phase, a pearlite, or a mixed phase thereof.

The structure of the high-strength seamless steel pipe may be adjusted by appropriately choosing a cooling rate of cooling according to the steel components, or appropriately choosing a heating temperature of quenching.

Grain Size Number of Prior Austenite Grains: 8.5 or More

The substructure of the martensite phase coarsens, and SSC resistance is deteriorated when the grain size number of prior austenite grains is less than 8.5. For this reason, the grain size number of prior austenite grains is limited to 8.5 or more. The grain size number is a measured value obtained according to the JIS G 0551 standard.

The grain size number of prior austenite grains may be adjusted by varying the heating rate, the heating temperature, the maintained temperature of quenching, and the number of quenching processes.

In the high-strength seamless steel pipe, the number of nitride inclusions, and the number of oxide inclusions are adjusted to fall in appropriate ranges by size to improve SSC resistance. Identification of nitride inclusions and oxide inclusions is made through automatic detection with a scanning electron microscope. The nitride inclusions contain Ti and Nb as main components, and the oxide inclusions contain Al, Ca and Mg as main components. The number of inclusions is a measured value from a cross section perpendicular to the rolling direction of the steel pipe (a cross section C perpendicular to the axial direction of the pipe). The inclusion size is the diameter of each inclusion. For the measurement of inclusion size, the area of an inclusion particle is determined, and the calculated diameter of a corresponding circle is used as the inclusion size.

Nitride Inclusions Having Size of 4 μm or More: 100 or Less Per 100 $mm^2$

Nitride inclusions become an initiation site of SSC cracking in a high-strength steel pipe of a grade equivalent to or higher than a yield strength of 125 ksi, and this adverse effect becomes more pronounced with a size of 4 μm or more. It is therefore desirable to reduce the number of nitride inclusions with a size of 4 μm or more as much as possible. However, the adverse effect on SSC resistance is negligible when the number of nitride inclusions of these sizes is 100 or less per 100 $mm^2$. Accordingly, the number of nitride inclusions having a size of 4 μm or more is limited to 100 or less, preferably 84 or less per 100 $mm^2$.

Nitride Inclusions Having Size of Less than 4 μm: 700 or Less Per 100 $mm^2$

Fine nitride inclusions with a size of less than 4 μm themselves do not become an initiation site of SSC generation. However, its adverse effect on SSC resistance cannot be ignored when the number of inclusion per 100 $mm^2$ increases above 700 in a high-strength steel pipe of a grade equivalent to or higher than a yield strength of 125 ksi. Accordingly, the number of nitride inclusions having a size of less than 4 μm is limited to 700 or less, preferably 600 or less per 100 $mm^2$.

Oxide Inclusions Having Size of 4 μm or More: 60 or Less Per 100 $mm^2$

Oxide inclusions become an initiation site of SSC cracking in a high-strength steel pipe of a grade equivalent to or higher than a yield strength of 125 ksi, and this adverse effect becomes more pronounced with a size of 4 μm or more. It is therefore desirable to reduce the number of oxide inclusions with a size of 4 μm or more as much as possible. However, the adverse effect on SSC resistance is negligible when the number of oxide inclusions of these sizes is 60 or less per 100 $mm^2$. Accordingly, the number of oxide inclusions having a size of 4 μm or more is limited to 60 or less, preferably 40 or less per 100 $mm^2$.

Oxide Inclusions Having Size of Less than 4 μm: 500 or Less Per 100 $mm^2$

Oxide inclusions become an initiation site of SSC cracking in a high-strength steel of a grade equivalent to or higher than a yield strength of 125 ksi even when the size is less than 4 μm, and its adverse effect on SSC resistance becomes more pronounced as the count increases. It is therefore desirable to reduce the number of oxide inclusions as much as possible, even for oxide inclusions with a size of less than 4 μm. However, the adverse effect is negligible when the count per 100 $mm^2$ is 500 or less. Accordingly, the number of oxide inclusions having a size of less than 4 μm is limited to 500 or less, preferably 400 or less per 100 $mm^2$.

Management of a molten steel refining step is particularly important in the adjustment of nitride inclusions and oxide inclusions. Desulfurization and dephosphorization are performed in a hot metal pretreatment, and this is followed by heat-stirring refining (LF) and RH vacuum degassing with a ladle after decarbonization and dephosphorization in a converter furnace. A sufficient process time is provided for the heat-stirring refining (LF) and the RH vacuum degassing. When producing an ingot (steel pipe material) by continuous casting, sealing is made with inert gas for the injection of molten steel from the ladle to a tundish, and the molten steel is electromagnetically stirred in a mold to float and separate the inclusions so that the nitride inclusions and the oxide inclusions are limited to the foregoing numbers per unit area.

A preferred method of production of the high-strength seamless steel pipe is described below.

A steel pipe material of the foregoing composition is heated, and a seamless steel pipe of a predetermined shape is obtained after hot working.

Preferably, the steel pipe material is obtained by melting molten steel of the foregoing composition by using a common melting method such as in a converter furnace, and forming an ingot (round ingot) by using a common casting technique such as continuous casting. The ingot may be hot rolled to produce a round steel ingot of a predetermined shape, or may be processed into a round steel ingot through casting and blooming.

In the high-strength seamless steel pipe, the nitride inclusions and the oxide inclusions are reduced to the foregoing specific numbers per unit area to further improve SSC resistance. To achieve this, N and O (oxygen) in the steel pipe material (an ingot or a steel ingot) need to be reduced as much as possible in the foregoing range of 0.006% or less for N, and 0.0030% or less for O (oxygen).

Management of a molten steel refining step is particularly important to achieve the foregoing specific numbers of nitride inclusions and oxide inclusions per unit area. Preferably, desulfurization and dephosphorization are performed in a hot metal pre-treatment, followed by heat-stirring refining (LF) and RH vacuum degassing with a ladle after decarbonization and dephosphorization in a converter furnace. The CaO concentration or CaS concentration in the inclusions decreases, and $MgO—Al_2O_3$ inclusions occur as the LF time increases. This improves SSC resistance. The O (oxygen) concentration in the molten steel decreases, and the size and the number of oxide inclusions become smaller as the RH time increases. It is therefore preferable to provide a process time of at least 30 minutes for the heat-stirring refining (LF), and a process time of at least 20 minutes for the RH vacuum degassing.

When producing an ingot (steel pipe material) by continuous casting, it is preferable that sealing is made with inert gas for the injection of molten steel from a ladle to a tundish, and the molten steel is electromagnetically stirred in a mold to float and separate the inclusions so that the nitride inclusions and the oxide inclusions become the specified numbers per unit area. The amount and size of nitride inclusions and oxide inclusions can be adjusted in this manner.

The ingot (steel pipe material) of the foregoing composition is heated in hot working at a heating temperature of 1,050 to 1,350° C. to make a seamless steel pipe of predetermined dimensions.

Heating Temperature: 1,050 to 1,350° C.

Dissolving the carbides in the steel pipe material becomes insufficient when the heating temperature is less than 1,050° C. On the other hand, a heating temperature above 1,350° C. produces coarse grains of microstructure, and coarsens TiN and other precipitates formed during solidification. Also coarsening of cementite deteriorates toughness. A high temperature in excess of 1,350° C. is not preferable because it produces thick scales on ingot surfaces, and causes surface defects during rolling. Such a high temperature also involves a large energy loss, and is not preferable in terms of saving energy. For these reasons, the heating temperature is limited to 1,050 to 1,350° C. The heating temperature is preferably 1,100° C. or more, and is preferably 1,300° C. or less.

The heated steel pipe material is subjected to hot working (pipe formation) with a Mannesmann-plug mill or Mannesmann-Mandrel hot rolling machine, and a seamless steel pipe of predetermined dimensions is obtained. A seamless steel pipe may be obtained through hot extrusion under pressure.

After hot working, the seamless steel pipe is subjected to cooling, whereby the pipe is cooled to a surface temperature of 200° C. or less at a cooling rate equal to or faster than air cooling.

Post-Hot Working Cooling (Cooling Rate: Equal to or Faster than Air Cooling, Cooling Stop Temperature: 200° C. or Less)

In our composition range, a structure with a main martensite phase can be obtained upon cooling the steel at a cooling rate equal to or faster than air cooling after the hot working. A transformation may be incomplete when air cooling (cooling) is finished before the surface temperature falls to 200° C. To avoid this, the post-hot working cooling is performed at a cooling rate equal to or faster than air cooling until the surface temperature becomes 200° C. or less. As used herein, "cooling rate equal to or faster than air cooling" means a rate of 0.1° C./s or higher. A cooling rate slower than 0.1° C./s results in a heterogeneous metal structure, and the metal structure becomes heterogeneous after the subsequent heat treatment.

The cooling performed at a cooling rate equal to or faster than air cooling is followed by tempering. The tempering involves heating to 600 to 740° C.

Tempering Temperature: 600 to 740° C.

The tempering is performed to reduce the dislocation density, and improve toughness and SSC resistance. With a tempering temperature of less than 600° C., reduction of a dislocation becomes insufficient, and excellent SSC resistance cannot be provided. On the other hand, a temperature above 740° C. causes severe softening of structure, and excellent high strength cannot be provided. It is therefore preferable to limit the tempering temperature to 600 to 740° C. The tempering temperature is preferably 660° C. or more, more preferably 670° C. or more. The tempering temperature is preferably 740° C. or less, more preferably 710° C. or less.

To stably provide desirable characteristics, it is desirable that the cooling performed at a cooling rate equal to or faster than air cooling after the hot working is followed by at least one round of quenching that involves reheating and quenching with water or the like, before tempering.

Reheating Temperature for Quenching: Between $Ac_3$ Transformation Point and 1,000° C.

Heating to an austenite single phase region fails, and a structure of primarily a martensite microstructure cannot be obtained when the reheating temperature is below the $Ac_3$ transformation point. On the other hand, a high temperature in excess of 1,000° C. causes adverse effects, including poor toughness due to coarsening of grains of microstructure, and thick surface oxide scales is easy to remove, and causes defects on a steel plate surface. Such excessively high temperatures also put an excess load on a heat treatment furnace, and are problematic in terms of saving energy. For these reasons, and considering the energy issue, the reheating temperature for the quenching is limited to a temperature between the $Ac_3$ transformation point and 1,000° C., preferably 950° C. or less.

The reheating is followed by quenching. The quenching involves water cooling to preferably 400° C. or less as measured at the center of the plate thickness, at an average cooling rate of 2° C./s or more, until the surface temperature becomes 200° C. or less, preferably 100° C. or less. The quenching may be repeated two or more times.

The $Ac_3$ transformation point is the temperature calculated according to the following equation:

$$Ac_3 \text{ transformation point } (^\circ\text{ C.}) = 937 - 476.5C + 56Si - 19.7Mn - 16.3Cu - 4.9Cr - 26.6Ni + 38.1Mo + 124.8V + 136.3Ti + 198Al + 3315B.$$

In the equation, C, Si, Mn, Cu, Cr, Ni, Mo, V, Ti, Al, and B represent the content of each element in mass %. In the calculation of $Ac_3$ transformation point, the content of the element is regarded as 0% when it is not contained in the composition.

The tempering, or the quenching and tempering may be followed by a correction process that corrects defects in the shape of the steel pipe by hot or cool working, as required.

Examples

Our steel pipes and methods will be described below in greater detail using Examples.

Hot metal tapped off from a blast furnace was desulfurized and dephosphorized in a hot metal pretreatment. After decarbonization and dephosphorization in a converter furnace, the metal was subjected to heat-stirring refining (LF; a process time of at most 60 min), and RH vacuum degassing (reflux rate: 120 ton/min, process time: 10 to 40 min), as summarized in Tables 2 and 3. This produced molten steels of the compositions represented in Table 1. Each steel was cast into an ingot by continuous casting (round ingot: 190 mmϕ)). For continuous casting, the process involved shielding of the tundish with Ar gas for steels other than AD, AE, AH, and AI. Steels other than Z, AA, AH, and AI were electromagnetically stirred in a mold.

The ingots were each charged into a heating furnace as a steel pipe material, heated, and maintained for 2 h at the heating temperatures shown in Tables 2 and 3. The heated steel pipe material was subjected to hot working using a Mannesmann-plug mill hot rolling machine to produce a seamless steel pipe (outer diameter of 178 to 229 mmϕ×12 to 32 mm wall thickness). Following the hot working, the steel was air cooled, and subjected to quenching and tempering under the conditions shown in Tables 2 and 3. Some steels were water cooled after the hot working, and subjected to tempering, or quenching and tempering.

A test pieces were collected from the seamless steel pipe produced above, and the structure were observed. The samples were also tested in a tensile test, and a sulfide stress corrosion cracking test, as follows.

(1) Structure Observation

A test pieces for structure observation were collected from the seamless steel pipe at a ¼t position from the inner surface side (t: pipe wall thickness), and a cross section (cross section C) orthogonal to the pipe longitudinal direction were polished, and the structure were exposed by corroding the surface with nital (a nitric acid-ethanol mixture). The structure is observed with a light microscope (magnification: 1,000×), and with a scanning electron microscope (magnification: 2,000 to 3,000×), and images were taken at at least 4 locations in the observed field. The photographic images of the structure were then analyzed to identify the constituent phases, and the fractions of the identified phases in the structure were calculated.

A test pieces for structure observation were also measured for prior austenite (y) grain size. A cross section (cross section C) orthogonal to the pipe longitudinal direction of the test pieces for structure observation were polished, and prior y grain boundaries were exposed by corroding the surface with picral (a picric acid-ethanol mixture). The structure were observed with a light microscope (magnification: 1,000×), and images were taken at at least 3 locations in the observed field. The grain size number of prior y grains were then determined from the micrographs of the structure using the cutting method specified by JIS G 0551.

The structure of the test pieces for structure observation were observed in a 400 $mm^2$ area using a scanning electron microscope (magnification: 2,000 to 3,000×). The inclusions were automatically detected from the shading of the observed image, and simultaneously quantified by automation with the EDX (energy dispersive X-ray analyzer) of the scanning microscope to find the type of inclusions, and measure the size and the number of inclusions. The inclusion type was determined by EDX quantitative analysis. The inclusions were categorized as nitride inclusions when they contained Ti and Nb as main components, and oxide inclusions when the main components were Al, Ca, and Mg. The term "main components" refers to when the elements are 65% or more in total.

The number of the grains of the identified inclusions were determined, and the diameter of a corresponding circle calculated from the area of each particle, and used as the inclusion size. Inclusions with a size of 4 μm or more, and inclusions with a size of less than 4 μm were counted to find the density (number of grains/100 $mm^2$). Inclusions with a longer side of less than 2 μm were not analyzed.

(2) Tensile Test

A JIS 10 tensile test pieces (rod-like test piece; diameter of the parallel section 12.5 mmϕ; length of the parallel section=60 mm; GL (Gage Length (distance between gage lines)=50 mm) were collected from the seamless steel pipe at a ¼t position from the inner surface side (t: pipe wall thickness) according to the JIS Z 2241 standard in such an orientation that the axial direction of the pipe was the tensile direction. The tensile characteristics (yield strength YS (0.5% proof stress)), tensile strength TS) were then determined in a tensile test.

(3) Sulfide Stress Corrosion Cracking Test

A tensile test pieces (diameter of the parallel section: 6.35 mm ϕ and length of the parallel section 25.4 mm) were collected from the seamless steel pipe at a ¼t position from the inner surface side (t: pipe wall thickness) in such an orientation that the axial direction of the pipe was the tensile direction.

The tensile test pieces were tested in a sulfide stress corrosion cracking test according to the test method specified in NACE TM0177 Method A. In the sulfide stress corrosion cracking test, the tensile test pieces were placed under a constant load in a test solution (an acetic acid-sodium acetate aqueous solution (liquid temperature: 24° C.) containing a 5.0 mass % saltwater solution of pH 3.5 with saturated 10 kPa hydrogen sulfide), in which the test pieces were held under 85% of the stress equating to the yield strength YS actually obtained in the tensile test (steel pipe No. 10 was placed under 90% of the stress equating to the yield strength YS). The samples were evaluated as "○: Good" (pass) when fracture did not occur by hour 720, and "x: Poor" (fail) when fracture occurred by hour 720. The sulfide stress corrosion cracking test was not performed when the yield strength did not achieve the target value.

The results are presented in Tables 4 and 5.

TABLE 1

| Steel | Compostion (mass %) | | | | | | | | | | | |
|---|---|---|---|---|---|---|---|---|---|---|---|---|
| No. | C | Si | Mn | P | S | Al | N | Cr | Mo | V | Nb | B |
| A | 0.26 | 0.21 | 0.90 | 0.008 | 0.0009 | 0.035 | 0.0016 | 0.88 | 0.81 | 0.142 | 0.007 | 0.0021 |
| B | 0.28 | 0.24 | 0.85 | 0.007 | 0.0017 | 0.030 | 0.0018 | 0.38 | 0.74 | 0.135 | 0.009 | 0.0025 |
| C | 0.27 | 0.22 | 0.75 | 0.008 | 0.0011 | 0.032 | 0.0042 | 1.04 | 0.95 | 0.105 | 0.003 | 0.0019 |
| D | 0.26 | 0.25 | 0.70 | 0.009 | 0.0009 | 0.035 | 0.0044 | 0.54 | 0.90 | 0.072 | 0.005 | 0.0021 |
| E | 0.28 | 0.21 | 0.60 | 0.010 | 0.0015 | 0.072 | 0.0054 | 2.16 | 0.98 | 0.045 | 0.009 | 0.0013 |
| F | 0.27 | 0.24 | 0.55 | 0.008 | 0.0010 | 0.067 | 0.0055 | 0.59 | 0.95 | 0.096 | 0.005 | 0.0015 |
| G | 0.30 | 0.21 | 0.60 | 0.009 | 0.0008 | 0.032 | 0.0053 | 0.72 | 0.69 | 0.062 | 0.002 | 0.0009 |
| H | 0.27 | 0.23 | 0.55 | 0.007 | 0.0012 | 0.037 | 0.0052 | 0.21 | 0.71 | 0.204 | 0.012 | 0.0014 |
| I | 0.29 | 0.22 | 0.59 | 0.009 | 0.0009 | 0.035 | 0.0031 | 0.64 | 0.51 | 0.079 | 0.008 | 0.0016 |
| J | 0.28 | 0.23 | 0.54 | 0.008 | 0.0011 | 0.062 | 0.0034 | 0.60 | 0.44 | 0.132 | 0.015 | 0.0015 |
| K | 0.28 | 0.35 | 0.45 | 0.009 | 0.0017 | 0.028 | 0.0035 | 0.66 | 0.28 | 0.154 | 0.007 | 0.0021 |
| L | 0.27 | 0.36 | 0.41 | 0.011 | 0.0008 | 0.032 | 0.0037 | 0.35 | 0.21 | 0.145 | 0.021 | 0.0019 |
| M | 0.19 | 0.25 | 0.46 | 0.010 | 0.0009 | 0.033 | 0.0038 | 0.71 | 0.75 | 0.184 | 0.007 | 0.0012 |
| N | 0.18 | 0.24 | 0.39 | 0.011 | 0.0011 | 0.038 | 0.0037 | 0.33 | 0.82 | 0.194 | 0.008 | 0.0013 |
| O | 0.54 | 0.13 | 1.05 | 0.009 | 0.0010 | 0.034 | 0.0029 | 1.15 | 0.76 | 0.125 | 0.010 | 0.0022 |
| P | 0.52 | 0.19 | 0.95 | 0.012 | 0.0014 | 0.033 | 0.0031 | 0.54 | 0.68 | 0.155 | 0.009 | 0.0014 |
| Q | 0.24 | 0.29 | 0.44 | 0.010 | 0.0012 | 0.030 | 0.0044 | 0.67 | 0.02 | 0.095 | 0.007 | 0.0022 |
| R | 0.25 | 0.31 | 0.46 | 0.008 | 0.0016 | 0.029 | 0.0033 | 0.23 | 0.01 | 0.080 | 0.008 | 0.0018 |
| S | 0.27 | 0.25 | 0.45 | 0.012 | 0.0011 | 0.034 | 0.0029 | 2.65 | 0.96 | 0.065 | 0.006 | 0.0015 |
| T | 0.33 | 0.20 | 0.43 | 0.007 | 0.0008 | 0.039 | 0.0036 | 0.67 | 0.95 | 0.052 | 0.035 | 0.0018 |
| U | 0.28 | 0.24 | 0.46 | 0.009 | 0.0009 | 0.035 | 0.0046 | 0.43 | 0.77 | 0.077 | 0.032 | 0.0016 |
| V | 0.32 | 0.25 | 0.43 | 0.014 | 0.0017 | 0.029 | 0.0042 | 0.71 | 0.95 | 0.053 | 0.007 | 0.0022 |
| W | 0.33 | 0.24 | 0.45 | 0.009 | 0.0007 | 0.032 | 0.0039 | 0.36 | 0.89 | 0.074 | 0.008 | 0.0014 |
| X | 0.29 | 0.32 | 0.70 | 0.010 | 0.0008 | 0.033 | 0.0066 | 0.61 | 0.71 | 0.055 | 0.009 | 0.0010 |
| Y | 0.25 | 0.33 | 0.61 | 0.009 | 0.0009 | 0.038 | 0.0068 | 0.38 | 0.65 | 0.072 | 0.009 | 0.0008 |
| Z | 0.28 | 0.23 | 0.75 | 0.009 | 0.0011 | 0.035 | 0.0042 | 0.72 | 0.69 | 0.056 | 0.007 | 0.0018 |
| AA | 0.35 | 0.24 | 0.70 | 0.008 | 0.0009 | 0.041 | 0.0039 | 0.42 | 0.76 | 0.073 | 0.010 | 0.0015 |
| AB | 0.28 | 0.28 | 0.62 | 0.011 | 0.0010 | 0.033 | 0.0057 | 0.70 | 0.95 | 0.055 | 0.007 | 0.0014 |
| AC | 0.26 | 0.25 | 0.58 | 0.010 | 0.0011 | 0.028 | 0.0055 | 0.45 | 0.87 | 0.072 | 0.008 | 0.0010 |
| AD | 0.27 | 0.33 | 0.61 | 0.011 | 0.0009 | 0.032 | 0.0080 | 0.86 | 0.95 | 0.047 | 0.014 | 0.0013 |
| AE | 0.25 | 0.23 | 0.62 | 0.012 | 0.0013 | 0.035 | 0.0078 | 0.56 | 0.93 | 0.067 | 0.009 | 0.0011 |
| AF | 0.26 | 0.26 | 0.73 | 0.011 | 0.0007 | 0.034 | 0.0029 | 0.80 | 0.96 | 0.214 | 0.008 | 0.0021 |
| AG | 0.26 | 0.24 | 0.77 | 0.010 | 0.0008 | 0.027 | 0.0032 | 0.42 | 0.81 | 0.203 | 0.014 | 0.0017 |
| AH | 0.31 | 0.26 | 0.31 | 0.009 | 0.0011 | 0.035 | 0.0058 | 0.90 | 0.84 | 0.085 | 0.008 | 0.0019 |
| AI | 0.30 | 0.27 | 0.34 | 0.012 | 0.0009 | 0.033 | 0.0054 | 0.36 | 0.79 | 0.051 | 0.015 | 0.0012 |
| AJ | 0.25 | 0.29 | 0.45 | 0.008 | 0.0011 | 0.043 | 0.0044 | 0.77 | 0.68 | 0.089 | 0.008 | 0.0023 |

| Steel | Compostion (mass %) | | | | | | | |
|---|---|---|---|---|---|---|---|---|
| No. | Ti | Cu | Ni | W | Ca | O | Ti/N | Remarks |
| A | 0.006 | — | — | — | — | 0.0016 | 3.8 | Example |
| B | 0.005 | — | — | — | — | 0.0014 | 2.8 | Example |
| C | 0.015 | 0.06 | — | — | — | 0.0009 | 3.6 | Example |
| D | 0.014 | 0.07 | — | — | — | 0.0012 | 3.2 | Example |
| E | 0.016 | — | — | — | 0.0023 | 0.0011 | 3.0 | Example |

TABLE 1-continued

| | | | | | | | | |
|---|---|---|---|---|---|---|---|---|
| F | 0.015 | — | — | — | 0.0018 | 0.0009 | 2.7 | Example |
| G | 0.019 | 0.33 | — | — | — | 0.0010 | 3.6 | Example |
| H | 0.016 | 0.23 | — | — | — | 0.0008 | 3.1 | Example |
| I | 0.013 | 0.21 | 0.45 | — | 0.0009 | 0.0014 | 4.2 | Example |
| J | 0.009 | 0.19 | 0.37 | — | 0.0010 | 0.0010 | 2.6 | Example |
| K | 0.015 | — | — | 1.22 | — | 0.0011 | 4.3 | Example |
| L | 0.012 | — | — | 0.96 | — | 0.0010 | 3.2 | Example |
| M | 0.012 | — | 0.33 | — | 0.0020 | 0.0015 | 3.3 | Comparative Example |
| N | 0.014 | — | 0.24 | — | 0.0024 | 0.0012 | 3.8 | Comparative Example |
| O | 0.009 | — | — | — | — | 0.0010 | 3.1 | Comparative Example |
| P | 0.016 | — | — | — | — | 0.0011 | 5.2 | Comparative Example |
| Q | 0.014 | — | — | — | — | 0.0012 | 3.2 | Comparative Example |
| R | 0.012 | — | — | — | — | 0.0008 | 3.6 | Comparative Example |
| S | 0.013 | — | — | — | — | 0.0009 | 4.5 | Comparative Example |
| T | 0.015 | — | — | — | — | 0.0008 | 4.2 | Comparative Example |
| U | 0.016 | — | — | — | — | 0.0009 | 3.5 | Comparative Example |
| V | 0.024 | — | — | — | — | 0.0012 | 5.7 | Comparative Example |
| W | 0.025 | — | — | — | — | 0.0011 | 6.4 | Comparative Example |
| X | 0.010 | 0.16 | 0.22 | — | 0.0022 | 0.0017 | 1.5 | Comparative Example |
| Y | 0.011 | 0.14 | 0.15 | — | 0.0019 | 0.0016 | 1.6 | Comparative Example |
| Z | 0.014 | 0.52 | — | — | 0.0021 | 0.0033 | 3.3 | Comparative Example |
| AA | 0.012 | 0.44 | — | — | 0.0016 | 0.0037 | 3.1 | Comparative Example |
| AB | 0.027 | — | — | — | — | 0.0014 | 4.7 | Comparative Example |
| AC | 0.028 | — | — | — | — | 0.0015 | 5.1 | Comparative Example |
| AD | 0.019 | — | — | — | — | 0.0035 | 2.4 | Comparative Example |
| AE | 0.018 | — | — | — | — | 0.0032 | 2.3 | Comparative Example |
| AF | 0.014 | 0.09 | — | — | — | 0.0012 | 4.8 | Example |
| AG | 0.016 | 0.08 | — | — | — | 0.0011 | 5.0 | Example |
| AH | 0.024 | — | — | — | — | 0.0013 | 4.1 | Example |
| AI | 0.025 | — | — | — | — | 0.0010 | 4.6 | Example |
| AJ | 0.015 | 1.16 | — | — | — | 0.0012 | 3.4 | Comparative Example |

Balance: Fe and unavoidable impurities

TABLE 2

| Steel pipe No. | Steel No. | Refining Process Time (min)***** LF | RH | Casting Sealing ****** | Electro-Magnetic stirring ******* | Heating Heating temperature (° C.) | Pipe dimensions Outer Diameter (mmϕ) | Wall thickness (mm) | Post-hot working cooling Cooling | Cooling Stop Temperature (° C.)* | Quenching Quenching temperature** (° C.) | Cooling Stop Temperature*** (° C.) | Tempering Tempering temperature (° C.) | $Ac_3$ Transformation point (° C.) | Remarks |
|---|---|---|---|---|---|---|---|---|---|---|---|---|---|---|---|
| 1 | A | 60 | 20 | ○ | ○ | 1230 | 178 | 25 | Air cooling | ≤100 | 900 | 150 | 690 | 866 | Example |
| 2 | A | 60 | 20 | ○ | ○ | 1230 | 229 | 32 | Air cooling | ≤100 | 950<br>900**** | 150<br>150**** | 680 | 866<br>866 | Example |
| 3 | B | 60 | 20 | ○ | ○ | 1230 | 178 | 25 | Air cooling | ≤100 | 920 | 150 | 690 | 862 | Example |
| 4 | B | 60 | 20 | ○ | ○ | 1230 | 178 | 25 | Air cooling | ≤100 | 950<br>920**** | 150<br>150**** | 680 | 862<br>862 | Example |
| 5 | C | 65 | 30 | ○ | ○ | 1200 | 178 | 25 | Air cooling | ≤100 | 900 | 150 | 700 | 864 | Example |
| 6 | C | 65 | 30 | ○ | ○ | 1230 | 220 | 12 | Air cooling | ≤100 | 900 | <100 | 700 | 864 | Example |
| 7 | C | 65 | 30 | ○ | ○ | 1230 | 229 | 32 | Water cooling | 200 | — | — | 720 | 864 | Example |
| 8 | C | 65 | 30 | ○ | ○ | 1230 | 229 | 32 | Water cooling | 200 | 900 | 150 | 700 | 864 | Example |
| 9 | C | 65 | 30 | ○ | ○ | 1230 | 229 | 32 | Air cooling | ≤100 | 900 | <100 | 690 | 864 | Example |
| 10 | D | 65 | 30 | ○ | ○ | 1200 | 220 | 12 | Air cooling | ≤100 | 930 | 150 | 700 | 870 | Example |
| 11 | D | 65 | 30 | ○ | ○ | 1230 | 220 | 12 | Air cooling | ≤100 | 930 | <100 | 700 | 870 | Example |
| 12 | D | 65 | 30 | ○ | ○ | 1230 | 178 | 25 | Water cooling | 200 | — | — | 720 | 870 | Example |
| 13 | D | 65 | 30 | ○ | ○ | 1230 | 178 | 25 | Water cooling | 200 | 930 | 150 | 700 | 870 | Example |
| 14 | D | 65 | 30 | ○ | ○ | 1230 | 178 | 25 | Air cooling | ≤100 | 930 | <100 | 690 | 870 | Example |
| 15 | E | 50 | 40 | ○ | ○ | 1230 | 178 | 25 | Air cooling | ≤100 | 900 | <100 | 690 | 855 | Example |
| 16 | E | 50 | 40 | ○ | ○ | 1230 | 178 | 25 | Air cooling | ≤100 | 1030 | <100 | 690 | 855 | Comparative Example |
| 17 | F | 50 | 40 | ○ | ○ | 1230 | 220 | 12 | Air cooling | ≤100 | 930 | <100 | 690 | 876 | Example |
| 18 | F | 50 | 40 | ○ | ○ | 1230 | 220 | 12 | Air cooling | ≤100 | 1030 | <100 | 690 | 876 | Comparative Example |
| 19 | G | 50 | 40 | ○ | ○ | 1230 | 178 | 25 | Air cooling | ≤100 | 890 | <100 | 690 | 831 | Example |
| 20 | H | 50 | 40 | ○ | ○ | 1230 | 220 | 12 | Air cooling | ≤100 | 930 | <100 | 690 | 870 | Example |

TABLE 2-continued

| Steel pipe No. | Steel No. | Refining Process Time (min)***** LF | RH | Casting Sealing ****** | Electro-Magnetic stirring ******* | Heating Heating temperature (° C.) | Pipe dimensions Outer Diameter (mmϕ) | Wall thickness (mm) | Post-hot working cooling Cooling | Cooling Stop Temperature (° C.)* | Quenching Quenching temperature** (° C.) | Cooling Stop Temperature*** (° C.) | Tempering Tempering temperature (° C.) | $Ac_3$ Transformation point (° C.) | Remarks |
|---|---|---|---|---|---|---|---|---|---|---|---|---|---|---|---|
| 21 | I | 50 | 30 | ○ | ○ | 1230 | 178 | 25 | Air cooling | ≤100 | 890 | <100 | 680 | 821 | Example |
| 22 | I | 50 | 30 | ○ | ○ | 1230 | 178 | 25 | Air cooling | ≤100 | 890 | <100 | 770 | 821 | Comparative Example |
| 23 | I | 50 | 30 | ○ | ○ | 1230 | 178 | 25 | Air cooling | ≤100 | 890 | 330 | 670 | 821 | Comparative Example |
| 24 | I | 50 | 20 | ○ | ○ | 1260 | 178 | 25 | Air cooling | ≤100 | — | — | 700 | 821 | Example |
| 25 | J | 50 | 30 | ○ | ○ | 1230 | 220 | 12 | Air cooling | ≤100 | 890 | <100 | 680 | 841 | Example |
| 26 | J | 50 | 30 | ○ | ○ | 1230 | 220 | 12 | Air cooling | ≤100 | 890 | <100 | 770 | 841 | Comparative Example |
| 27 | J | 50 | 30 | ○ | ○ | 1230 | 220 | 12 | Air cooling | ≤100 | 890 | 330 | 670 | 841 | Comparative Example |
| 28 | J | 50 | 20 | ○ | ○ | 1260 | 220 | 12 | Air cooling | ≤100 | — | — | 700 | 841 | Example |

*Air Cooling Stop Temperature: surface temperature
**Reheating temperature
***Quenching and Cooling Stop Temperature: surface temperature
****Second quenching
*****LF: Heat-stirring refining, RH: Vacuum degassing
******) Sealing for injection from ladle to tundish Present: ○, Absent: X
*******) Electromagnetic stirring in mold Present: ○, Absent: X

TABLE 3

| Steel Pipe No. | Steel No. | Refining Process time (min)***** LF | Refining Process time (min)***** RH | Casting Sealing ****** | Casting Electro-magnetic stirring ******* | Heating Heating temperature (° C.) | Pipe dimensions Outer Diameter (mmϕ) | Pipe dimensions Wall thickness (mm) | Post-hot working cooling Cooling | Post-hot working cooling Cooling Stop Temperature (° C.)* | Quenching Quenching temperature** (° C.) | Quenching Cooling Stop Temperature*** (° C.) | Tempering Tempering temperature (° C.) | $Ac_3$ Transformation point (° C.) | Remarks |
|---|---|---|---|---|---|---|---|---|---|---|---|---|---|---|---|
| 29 | K | 50 | 30 | ○ | ○ | 1230 | 178 | 25 | Air cooling | ≤100 | 890 | <100 | 680 | 855 | Example |
| 30 | L | 50 | 30 | ○ | ○ | 1230 | 220 | 12 | Air cooling | ≤100 | 890 | <100 | 680 | 862 | Example |
| 31 | M | 25 | 30 | ○ | ○ | 1230 | 178 | 25 | Air cooling | ≤100 | 950 | <100 | 680 | 903 | Comparative Example |
| 32 | N | 25 | 30 | ○ | ○ | 1230 | 220 | 12 | Air cooling | ≤100 | 950 | <100 | 680 | 915 | Comparative Example |
| 33 | O | 40 | 30 | ○ | ○ | 1230 | 178 | 25 | Air cooling | ≤100 | 900 | <100 | 680 | 720 | Comparative Example |
| 34 | P | 40 | 30 | ○ | ○ | 1230 | 220 | 12 | Air cooling | ≤100 | 880 | <100 | 680 | 739 | Comparative Example |
| 35 | Q | 40 | 30 | ○ | ○ | 1230 | 178 | 25 | Air cooling | ≤100 | 900 | <100 | 680 | 855 | Comparative Example |
| 36 | R | 40 | 30 | ○ | ○ | 1230 | 220 | 12 | Air cooling | ≤100 | 900 | <100 | 680 | 851 | Comparative Example |
| 37 | S | 40 | 30 | ○ | ○ | 1230 | 178 | 25 | Air cooling | ≤100 | 900 | <100 | 650 | 859 | Comparative Example |
| 38 | T | 40 | 30 | ○ | ○ | 1230 | 178 | 25 | Air cooling | ≤100 | 900 | <100 | 700 | 836 | Comparative Example |
| 39 | U | 40 | 30 | ○ | ○ | 1230 | 220 | 12 | Air cooling | ≤100 | 900 | <100 | 700 | 865 | Comparative Example |
| 40 | V | 40 | 30 | ○ | ○ | 1230 | 178 | 25 | Air cooling | ≤100 | 900 | <100 | 700 | 845 | Comparative Example |
| 41 | W | 40 | 30 | ○ | ○ | 1230 | 220 | 12 | Air cooling | ≤100 | 900 | <100 | 700 | 842 | Comparative Example |
| 42 | X | 40 | 30 | ○ | ○ | 1230 | 178 | 25 | Air cooling | ≤100 | 900 | <100 | 700 | 836 | Comparative Example |
| 43 | Y | 40 | 30 | ○ | ○ | 1230 | 220 | 12 | Air cooling | ≤100 | 900 | <100 | 700 | 864 | Comparative Example |
| 44 | Z | 25 | 10 | ○ | X | 1230 | 178 | 25 | Air cooling | ≤100 | 900 | <100 | 700 | 838 | Comparative Example |
| 45 | AA | 25 | 10 | ○ | X | 1230 | 220 | 12 | Air cooling | ≤100 | 900 | <100 | 700 | 812 | Comparative Example |
| 46 | AB | 40 | 30 | ○ | ○ | 1230 | 178 | 25 | Air cooling | ≤100 | 900 | <100 | 700 | 862 | Comparative Example |
| 47 | AC | 40 | 30 | ○ | ○ | 1230 | 220 | 12 | Air cooling | ≤100 | 930 | <100 | 700 | 873 | Comparative Example |
| 48 | AD | 25 | 10 | X | ○ | 1230 | 178 | 25 | Air cooling | ≤100 | 900 | 150 | 700 | 866 | Comparative Example |

TABLE 3-continued

| Steel Pipe No. | Steel No. | Refining Process time (min)***** LF | RH | Casting Sealing ****** | Electro-magnetic stirring ******* | Heating Heating temperature (° C.) | Pipe dimensions Outer Diameter (mmϕ) | Wall thickness (mm) | Post-hot working cooling Cooling | Cooling Stop Temperature (° C.)* | Quenching Quenching temperature** (° C.) | Cooling Stop Temperature*** (° C.) | Tempering Tempering temperature (° C.) | $Ac_3$ Transformation point (° C.) | Remarks |
|---|---|---|---|---|---|---|---|---|---|---|---|---|---|---|---|
| 49 | AE | 25 | 10 | X | ○ | 1230 | 220 | 12 | Air cooling | ≤100 | 930 | 150 | 700 | 876 | Comparative Example |
| 50 | AF | 50 | 25 | ○ | ○ | 1230 | 229 | 32 | Air cooling | ≤100 | 900 | <100 | 700 | 887 | Example |
| 51 | AG | 50 | 25 | ○ | ○ | 1230 | 178 | 25 | Air cooling | ≤100 | 930 | <100 | 700 | 887 | Example |
| 52 | AH | 50 | 30 | X | X | 1230 | 229 | 32 | Air cooling | ≤100 | 900 | <100 | 700 | 852 | Comparative Example |
| 53 | AJ | 50 | 30 | X | X | 1230 | 178 | 25 | Air cooling | ≤100 | 930 | <100 | 700 | 855 | Comparative Example |
| 54 | B | 60 | 20 | ○ | ○ | 1230 | 229 | 32 | Air cooling | ≤100 | 950<br>900**** | 150<br>150**** | 680 | 862<br>862 | Comparative Example |
| 55 | D | 65 | 30 | ○ | ○ | 1230 | 229 | 32 | Air cooling | ≤100 | 900 | <100 | 690 | 870 | Comparative Example |
| 56 | H | 50 | 40 | ○ | ○ | 1230 | 178 | 25 | Air cooling | ≤100 | 890 | <100 | 690 | 870 | Comparative Example |
| 57 | L | 50 | 30 | ○ | ○ | 1230 | 178 | 25 | Air cooling | ≤100 | 890 | <100 | 680 | 862 | Comparative Example |
| 58 | AG | 50 | 25 | ○ | ○ | 1230 | 229 | 32 | Air cooling | ≤100 | 900 | <100 | 700 | 887 | Comparative Example |
| 59 | AJ | 50 | 30 | ○ | ○ | 1260 | 178 | 25 | Air cooling | ≤100 | 900 | <100 | 690 | 858 | Comparative Example |

*Air Cooling Stop Temperature: surface temperature
**Reheating temperature
***Quenching and Cooling Stop Temperature: surface temperature
*****LF: Heat-stirring refining, RH: Vacuum degassing
******) Sealing for injection from ladle to tundish Present: ○, Absent: X
*******) Electromagnetic stirring in mold Present: ○, Absent: X

TABLE 4

| Steel pipe No. | Steel No. | Structure: Density of nitride inclusions* Less than 4 μm | Density of nitride inclusions* 4 μm or more | Density of oxide inclusions* Less than 4 μm | Density of oxide inclusions* 4 μm or more | Type** | TM structure fraction (volume %) | Prior γ grain size number | Tensile characteristics: Yield strength YS (MPa) | Tensile strength TS (MPa) | SSC resistance: Evaluation | Stress (MPa) | Remarks |
|---|---|---|---|---|---|---|---|---|---|---|---|---|---|
| 1 | A | 442 | 25 | 272 | 41 | TM + B | 97 | 9.5 | 888 | 972 | ○: Good | 755 | Example |
| 2 | A | 403 | 24 | 313 | 32 | TM + B | 96 | 9.5 | 908 | 981 | ○: Good | 772 | Example |
| 3 | B | 378 | 22 | 298 | 35 | TM + B | 98 | 9 | 892 | 975 | ○: Good | 758 | Example |
| 4 | B | 398 | 25 | 326 | 29 | TM + B | 97 | 9.5 | 913 | 983 | ○: Good | 776 | Example |
| 5 | C | 587 | 75 | 205 | 22 | TM + B | 97 | 10 | 895 | 972 | ○: Good | 761 | Example |
| 6 | C | 567 | 70 | 189 | 16 | TM + B | 98 | 10 | 873 | 949 | ○: Good | 742 | Example |
| 7 | C | 524 | 67 | 215 | 21 | TM + B | 98 | 9 | 927 | 1004 | ○: Good | 788 | Example |
| 8 | C | 553 | 79 | 188 | 25 | TM + B | 96 | 11 | 885 | 956 | ○: Good | 752 | Example |
| 9 | C | 589 | 82 | 193 | 30 | TM + B | 97 | 10 | 906 | 984 | ○: Good | 770 | Example |
| 10 | D | 569 | 72 | 231 | 16 | TM + B | 98 | 9 | 898 | 971 | ○: Good | 763 | Example |
| | | | | | | | | | | | ○: Good | 808 | Example |
| 11 | D | 553 | 71 | 202 | 13 | TM + B | 97 | 10 | 868 | 942 | ○: Good | 738 | Example |
| 12 | D | 537 | 64 | 241 | 15 | TM + B | 98 | 9 | 932 | 1006 | ○: Good | 792 | Example |
| 13 | D | 579 | 80 | 201 | 22 | TM + B | 96 | 12 | 880 | 949 | ○: Good | 748 | Example |
| 14 | D | 566 | 79 | 219 | 24 | TM + B | 98 | 10 | 910 | 987 | ○: Good | 774 | Example |
| 15 | E | 632 | 52 | 209 | 16 | TM + B | 97 | 11 | 926 | 997 | ○: Good | 787 | Example |
| 16 | E | 651 | 73 | 233 | 24 | TM + B | 97 | 8 | 943 | 1020 | x: Poor | 802 | Comparative Example |
| 17 | F | 658 | 53 | 222 | 13 | TM + B | 98 | 11 | 929 | 996 | ○: Good | 790 | Example |
| 18 | F | 664 | 70 | 259 | 18 | TM + B | 97 | 7.5 | 948 | 1022 | x: Poor | 806 | Comparative Example |
| 19 | G | 543 | 72 | 189 | 22 | TM + B | 97 | 10 | 956 | 1028 | ○: Good | 813 | Example |
| 20 | H | 569 | 73 | 202 | 19 | TM + B | 96 | 10 | 951 | 1021 | ○: Good | 808 | Example |
| 21 | I | 451 | 61 | 226 | 34 | TM + B | 97 | 10 | 944 | 1018 | ○: Good | 802 | Example |
| 22 | I | 423 | 49 | 204 | 30 | TM + B | 98 | 10 | 828 | 913 | — | 704 | Comparative Example |
| 23 | I | 418 | 53 | 193 | 42 | TM + B | 80 | 10.5 | 807 | 897 | — | 686 | Comparative Example |
| 24 | I | 445 | 52 | 190 | 55 | TM + B | 96 | 10.5 | 866 | 983 | ○: Good | 736 | Example |
| 25 | J | 464 | 58 | 252 | 28 | TM + B | 97 | 10 | 947 | 1017 | ○: Good | 805 | Example |
| 26 | J | 449 | 50 | 217 | 27 | TM + B | 98 | 10 | 832 | 916 | — | 707 | Comparative Example |
| 27 | J | 431 | 50 | 219 | 36 | TM + B | 80 | 10.5 | 811 | 895 | — | 689 | Comparative Example |
| 28 | J | 471 | 53 | 203 | 51 | TM + B | 97 | 10.5 | 879 | 956 | ○: Good | 747 | Example |

*Density: Number of inclusions/100 $mm^2$

**TM: Tempered martensite, B: Bainite

TABLE 5

| Steel pipe No. | Steel No. | Structure: Density of nitride inclusions* Less than 4 μm | Density of nitride inclusions* 4 μm or more | Density of oxide inclusions* Less than 4 μm | Density of oxide inclusions* 4 μm or more | Type** | TM structure fraction (volume %) | Prior γ grain size number | Tensile charateristics: Yield strength YS (MPa) | Tensile strength TS (MPa) | SSC resistance: Evaluation | Stress (MPa) | Remarks |
|---|---|---|---|---|---|---|---|---|---|---|---|---|---|
| 29 | K | 615 | 66 | 222 | 30 | TM + B | 98 | 10.5 | 927 | 1003 | ○: Good | 788 | Example |
| 30 | L | 628 | 63 | 248 | 24 | TM + B | 97 | 10.5 | 930 | 1002 | ○: Good | 791 | Example |
| 31 | M | 436 | 59 | 264 | 25 | TM + B | 98 | 9.5 | 816 | 899 | — | 694 | Comparative Example |
| 32 | N | 462 | 60 | 277 | 22 | TM + B | 98 | 9.5 | 821 | 890 | — | 698 | Comparative Example |
| 33 | O | 687 | 55 | 283 | 19 | TM + B | 98 | 8.5 | 1095 | 1165 | x: Poor | 931 | Comparative Example |
| 34 | P | 578 | 52 | 309 | 13 | TM + B | 97 | 9 | 1098 | 1164 | x: Poor | 933 | Comparative Example |
| 35 | Q | 626 | 43 | 292 | 24 | TM + B | 98 | 10.5 | 987 | 1043 | x: Poor | 839 | Comparative Example |

TABLE 5-continued

| Steel pipe No. | Steel No. | Structure: Density of nitride inclusions* Less than 4 μm | Density of nitride inclusions* 4 μm or more | Density of oxide inclusions* Less than 4 μm | Density of oxide inclusions* 4 μm or more | Type** | TM structure fraction (volume %) | Prior γ grain size number | Tensile charateristics: Yield strength YS (MPa) | Tensile strength TS (MPa) | SSC resistance: Evaluation | Stress (MPa) | Remarks |
|---|---|---|---|---|---|---|---|---|---|---|---|---|---|
| 36 | R | 652 | 44 | 305 | 21 | TM + B | 97 | 10.5 | 991 | 1046 | x: Poor | 842 | Comparative Example |
| 37 | S | 510 | 78 | 233 | 27 | TM + B | 98 | 11.5 | 960 | 1144 | x: Poor | 816 | Comparative Example |
| 38 | T | 691 | 135 | 167 | 13 | TM + B | 96 | 10 | 886 | 983 | x: Poor | 753 | Comparative Example |
| 39 | U | 654 | 136 | 180 | 10 | TM + B | 96 | 10.5 | 891 | 985 | x: Poor | 757 | Comparative Example |
| 40 | V | 1225 | 78 | 237 | 28 | TM + B | 98 | 10 | 959 | 1035 | x: Poor | 815 | Comparative Example |
| 41 | W | 922 | 75 | 263 | 22 | TM + B | 98 | 10 | 964 | 1037 | x: Poor | 819 | Comparative Example |
| 42 | X | 623 | 125 | 374 | 31 | TM + B | 98 | 10.5 | 897 | 980 | x: Poor | 762 | Comparative Example |
| 43 | Y | 649 | 126 | 387 | 28 | TM + B | 97 | 10 | 901 | 983 | x: Poor | 766 | Comparative Example |
| 44 | Z | 683 | 34 | 585 | 34 | TM + B | 98 | 10.5 | 874 | 946 | x: Poor | 743 | Comparative Example |
| 45 | AA | 696 | 31 | 611 | 28 | TM + B | 97 | 11 | 879 | 948 | x: Poor | 747 | Comparative Example |
| 46 | AB | 554 | 84 | 277 | 18 | TM + B | 98 | 10 | 900 | 981 | x: Poor | 765 | Comparative Example |
| 47 | AC | 628 | 85 | 290 | 15 | TM + B | 98 | 10.5 | 904 | 984 | x: Poor | 768 | Comparative Example |
| 48 | AD | 665 | 70 | 844 | 112 | TM + B | 97 | 10 | 888 | 967 | x: Poor | 755 | Comparative Example |
| 49 | AE | 578 | 67 | 870 | 106 | TM + B | 98 | 10 | 891 | 966 | x: Poor | 757 | Comparative Example |
| 50 | AF | 550 | 39 | 256 | 33 | TM + B | 98 | 11 | 933 | 1001 | ○: Good | 793 | Example |
| 51 | AG | 576 | 40 | 269 | 30 | TM + B | 98 | 10.5 | 937 | 1004 | ○: Good | 796 | Example |
| 52 | AH | 956 | 207 | 533 | 124 | TM + B | 98 | 10.5 | 912 | 979 | x: Poor | 775 | Comparative Example |
| 53 | AI | 869 | 174 | 559 | 118 | TM + B | 98 | 11 | 917 | 981 | x: Poor | 779 | Comparative Example |
| 54 | B | 380 | 23 | 315 | 28 | TM + B | 90 | 9 | 855 | 923 | — | 727 | Comparative Example |
| 55 | D | 552 | 68 | 225 | 21 | TM + B | 88 | 9.5 | 843 | 920 | — | 717 | Comparative Example |
| 56 | H | 549 | 65 | 212 | 21 | TM + B | 82 | 9.5 | 831 | 892 | — | 706 | Comparative Example |
| 57 | L | 595 | 62 | 274 | 26 | TM + B | 85 | 10.5 | 847 | 929 | — | 720 | Comparative Example |
| 58 | AG | 550 | 46 | 248 | 29 | TM + B | 83 | 10.5 | 833 | 912 | — | 708 | Comparative Example |
| 59 | AJ | 596 | 65 | 230 | 29 | TM + B | 98 | 9.5 | 942 | 1025 | x: Poor | 801 | Comparative Example |

*Density: Number of inclusions/100 $mm^2$
**TM: Tempered martensite, B: Bainite

The seamless steel pipes of our Examples all have excellent SSC resistance, and high strength with the yield strength YS of 862 MPa or more. The yield strength YS of the steel pipe is 965 MPa or less in all of our Examples. On the other hand, the Comparative Examples have poor yield strength YS, and were unable to achieve the desired level of high strength. The SSC resistance is also poor.

The prior austenite grains coarsened, and the SSC resistance is poor in steel pipe No. 16 and steel pipe No. 18 (steel No. E, and steel No. F) of Table 2 subjected to quenching temperatures higher than our upper limit temperature (Table 4).

The strength is poor in steel pipe No. 22 and steel pipe No. 26 (steel No. I, and steel No. J) of Table 2 subjected to tempering temperatures higher than our upper limit temperature. Accordingly, the SSC resistance test was not performed for these samples (Table 4).

Steel pipe No. 23 and steel pipe No. 27 (steel No. I, and steel No. J) of Table 2 in which the Cooling Stop Temperature of the quenching is higher than our upper limit temperature fail to produce a desired structure with a main martensite phase, and have poor strength. Accordingly, the SSC resistance test was not performed for those samples (Table 4).

Steel pipe No. 31 and steel pipe No. 32 (steel No. M, and steel No. N in Table 1) in which the C content was below our lower limit fail to have the desired level of high strength. Accordingly, the SSC resistance test is not performed for those samples (Table 5).

Steel pipe No. 33 and steel pipe No. 34 (steel No. O, and steel No. P in Table 1) in which the C content exceeded our upper limit have high strength in our tempering temperature range. The SSC resistance is poor (Table 5).

Steel pipe No. 35 and steel pipe No. 36 (steel No. Q, and steel No. R in Table 1) in which the Mo content is below our lower limit have poor SSC resistance (Table 5).

The SSC resistance is poor in steel pipe No. 37 (steel No. S in Table 1) in which the Cr content exceeded our upper limit (Table 5).

The number of inclusions is far outside of our range, and the SSC resistance is poor in steel pipe No. 38 and steel pipe No. 39 (steel No. T, and steel No. U in Table 1) in which the Nb content is far outside our range (Table 5).

The number of nitride inclusions, and the number of oxide inclusions are outside of our range, and the SSC resistance is poor in steel pipe No. 40 to No. 43 (steel No. V to No. Y in Table 1) in which Ti/N is outside of our range (Table 5).

The number of oxide inclusions is outside of our range, and the SSC resistance is poor in steel pipe No. 44 and steel pipe No. 45 (steel No. Z, and steel No. AA in Table 1) that contained O (oxygen) in contents above our upper limit (Table 5).

The SSC resistance is poor in steel pipe No. 46 and steel pipe No. 47 (steel No. AB, and steel No. AC in Table 1) that contained Ti in contents above our upper limit (Table 5).

The number of oxide inclusions is outside of our range, and the SSC resistance is poor in steel pipe No. 48 and steel pipe No. 49 (steel No. AD, and steel No. AE in Table 1) in which the N and O contents exceeded our upper limits (Table 5).

The SSC resistance is poor in steel pipe No. 52 and steel pipe No. 53 (steel No. AH, and steel No. AI in Table 1) in which the components are within our range, but the number of nitride inclusions, and the number of oxide inclusions are outside our range (Table 5).

The SSC resistance is poor in steel pipe No. 59 (steel No. AJ in Table 1) in which the Cu content exceeds our upper limit (Table 5).

By focusing on the Cr content, steel pipe No. 2 of Table 4 (steel No. A in Table 1) with the Cr content of 0.6 mass % or more has stable hardenability, a martensite volume fraction of 95% or more, and a wall thickness of 32 mm, as compared to steel pipe No. 54 of Table 5 (steel No. B in Table 1) in which the Cr content is less than 0.6 mass %, despite that other conditions are the same.

Steel pipe No. 9 of Table 4 (steel No. C in Table 1) with a Cr content of 0.6 mass % or more has stable hardenability, a martensite volume fraction of 95% or more, and a wall thickness of 32 mm, as compared to steel pipe No. 55 of Table 5 (steel No. D in Table 1) in which the Cr content is less than 0.6 mass %, despite that other conditions are the same.

Steel pipe No. 50 of Table 5 (steel No. AF in Table 1) with a Cr content of 0.6 mass % or more has stable hardenability, a martensite volume fraction of 95% or more, and a wall thickness of 32 mm, as compared to steel pipe No. 58 of Table 5 (steel No. AG in Table 1) in which the Cr content is less than 0.6 mass %, despite that other conditions are the same.

Steel pipe No. 19 of Table 4 (steel No. G in Table 1) with the Cr content of 0.6 mass % or more has stable hardenability, a martensite volume fraction of 95% or more, and a wall thickness of 25 mm, compared to steel pipe No. 56 of Table 5 (steel No. H in Table 1) in which the Cr content is less than 0.6 mass %, despite that other conditions are the same. Similarly, steel pipe No. 29 of Table 5 (steel No. K in Table 1) with a Cr content of 0.6 mass % or more has stable hardenability, a martensite volume fraction of 95% or more, and a wall thickness of 25 mm, compared to steel pipe No. 57 of Table 5 (steel No. L in Table 1) in which the Cr content is less than 0.6 mass %, despite that other conditions are the same.

The invention claimed is:

1. A high-strength seamless steel pipe for oil country tubular goods of a composition consisting of C: 0.20 to 0.50 mass %, Si: 0.05 to 0.40 mass %, Mn: 0.5 to 0.8 mass %, P: 0.015 mass % or less, S: 0.005 mass % or less, Al: 0.005 to 0.1 mass %, N: 0.006 mass % or less, Cr: 0.1 to 2.5 mass %, Mo: 0.1 to 1.0 mass %, V: 0.03 to 0.3 mass %, Nb: 0.001 to 0.030 mass %, B: 0.0003 to 0.0030 mass %, O (oxygen): 0.0030 mass % or less, Ti: 0.003 to 0.025 mass %, and Cu: 0.03 to 1.0 mass %, optionally at least one selected from Ca: 0.0005 to 0.0050 mass %, Ni: 1.0 mass % or less, and W: 3.0 mass % or less, and the balance Fe and unavoidable impurities, and satisfying Ti/N=2.0 to 5.5, wherein the high-strength seamless steel pipe has a structure in which a volume fraction of tempered martensite is 95% or more, and a prior austenite grain size number is 8.5 or more, and that contains nitride inclusions having a size of 4 μm or more and whose number is 100 or less per 100 $mm^2$, nitride inclusions having a size of less than 4 μm and whose number is 700 or less per 100 $mm^2$, oxide inclusions having a size of 4 μm or more and whose number is 60 or less per 100 $mm^2$, and oxide inclusions having a size of less than 4 μm and whose number is 500 or less per 100 $mm^2$, in a cross section perpendicular to a rolling direction, and wherein the high-strength seamless steel pipe has a yield strength YS of 862 MPa or more.

2. A method of producing the high-strength seamless steel pipe for oil country tubular goods of claim 1, comprising:

heating a steel pipe material at a heating temperature of 1,050 to 1,350° C., and subjecting the steel pipe material to hot working to obtain a seamless steel pipe of a predetermined shape; and cooling the seamless steel pipe after the hot working at a cooling rate equal to or faster than air cooling until a surface temperature becomes 200° C. or less, and tempering the seamless steel pipe by heating the pipe to 600 to 740° C.

3. The method according to claim 2, wherein the seamless steel pipe is subjected to quenching at least once after the cooling and before the tempering, the quenching involving reheating at a temperature between an $Ac_3$ transformation point and 1,000° C., and quenching to a surface temperature of 200° C. or less.

4. The high-strength seamless steel pipe for oil country tubular goods according to claim 1, wherein the composition only optionally includes at least one selected from Ni: 1.0 mass % or less, and W: 3.0 mass % or less.

* * * * *